US009364960B2

(12) United States Patent
Ohara et al.

(10) Patent No.: US 9,364,960 B2
(45) Date of Patent: Jun. 14, 2016

(54) ROTARY ELECTRIC SHAVER

(71) Applicant: Izumi Products Company, Matsumoto-shi, Nagano (JP)

(72) Inventors: Toshihiko Ohara, Matsumoto (JP); Hideaki Koike, Matsumoto (JP); Toshihide Miyasaka, Matsumoto (JP)

(73) Assignee: IZUMI PRODUCTS COMPANY, Nagano (JP)

( * ) Notice: Subject to any disclaimer, the term of this patent is extended or adjusted under 35 U.S.C. 154(b) by 183 days.

(21) Appl. No.: 14/104,789

(22) Filed: Dec. 12, 2013

(65) Prior Publication Data

US 2014/0165407 A1 Jun. 19, 2014

(30) Foreign Application Priority Data

Dec. 14, 2012 (JP) ..... 2012-273365

(51) Int. Cl.
*B26B 19/14* (2006.01)

(52) U.S. Cl.
CPC ..... *B26B 19/14* (2013.01)

(58) Field of Classification Search
CPC ..... B26B 19/14
USPC ..... 30/43.4, 43.5, 43.6, 346.51
See application file for complete search history.

(56) References Cited

U.S. PATENT DOCUMENTS

| | | | | |
|---|---|---|---|---|
| 4,038,748 | A * | 8/1977 | Tyler | 30/43.6 |
| 6,212,776 | B1 * | 4/2001 | Izumi et al. | 30/43.4 |
| 6,968,621 | B1 | 11/2005 | Steinberg | |
| 7,222,428 | B2 * | 5/2007 | Koike | 30/43.5 |
| 7,487,592 | B2 * | 2/2009 | Koike | 30/43.4 |
| 7,743,508 | B2 * | 6/2010 | Shimizu | 30/43.6 |
| 8,393,082 | B2 * | 3/2013 | Shimizu | 30/43.6 |
| 2011/0173815 | A1 | 7/2011 | Koike | |

FOREIGN PATENT DOCUMENTS

| | | | |
|---|---|---|---|
| EP | 1 637 293 | A1 | 3/2006 |
| JP | 2011-143101 | A | 7/2011 |

* cited by examiner

*Primary Examiner* — Omar Flores Sanchez
(74) *Attorney, Agent, or Firm* — Birch, Stewart, Kolasch & Birch, LLP

(57) ABSTRACT

A rotary electric shaver with an outer cutter having a circular shaving top surface with numerous hair introduction openings and an inner cutter having a small cutter slidably rotating in contact with a bottom surface of the outer cutter. The rotary electric shaver includes an outer cutter set wherein the outer cutter is assembled in an outer cutter holding unit and an inner cutter set wherein the inner cutter is assembled in an inner cutter holding unit. The outer cutter set and the inner cutter set are respectively provided with a positioning convex portion on one and a positioning concave portion on the other. The positioning convex portion can fit in the positioning concave portion such that the outer cutter set can be assembled with the inner cutter set only in a case where the outer cutter set and the inner cutter set are in a predetermined assembly position.

3 Claims, 5 Drawing Sheets

ROTARY ELECTRIC SHAVER

CROSS-REFERENCE TO RELATED APPLICATION

This application is based upon and claims the benefit of priority of the prior Japanese Patent Application No. P2012-273365, filed on Dec. 14, 2012, and the entire contents of which are incorporated herein by reference.

FIELD

The present invention relates to a rotary electric shaver.

BACKGROUND

For example, as described in PTL 1, a rotary electric shaver that includes an outer cutter which has a circular shaving surface as a top surface where numerous hair introduction openings are formed and an inner cutter which has a small cutter which rotates slidingly in contact with a bottom surface of the outer cutter from below the shaving surface has been known.

CITATION LIST

Patent Literature

PTL 1: JP-A-2011-143101

SUMMARY

Technical Problem

Here, an outer cutter set and an inner cutter set of a rotary electric shaver that is described in PTL 1 have a configuration in which an outer cutter and an inner cutter are respectively provided in a plurality of sets (in this case, three sets) in a point symmetrical manner. Accordingly, when assembling the outer cutter set and the inner cutter set, if each position is mutually displaced by a predetermined angle (in this case, 120°), a plurality of assembly methods (in this case, three) can be obtained.

However, in the rotary electric shaver, the outer cutter and the inner cutter are processed by precision surface finishing when the outer cutter set and the inner cutter set are in a predetermined assembly position. Accordingly, it is possible to perform set sharpness in cutting only in a case where the outer cutter set and the inner cutter set are in a predetermined assembly position. Meanwhile, for example, after a user separates the outer cutter set and the inner cutter set for ordinary maintenance and carries out cleaning and the like, if the user assembles the outer cutter set and the inner cutter set out of a predetermined assembly position by mistake, it is not possible to perform the set sharpness in cutting, thereby causing a problem of deteriorated sharpness in cutting.

The present invention has been made in consideration of the above-described circumstance. The invention has an object to provide a rotary electric shaver in which an outer cutter set and an inner cutter set are free or easy to be prevented from being displaced from a predetermined assembly position when a user carries out maintenance such as cleaning.

Solution to Problem

As an exemplary embodiment, below-disclosed means solves the problem.

In a rotary electric shaver that includes an outer cutter which has a circular shaving surface as a top surface where numerous hair introduction openings are formed and an inner cutter which has a small cutter which rotates slidingly in contact with a bottom surface of the outer cutter from below the shaving surface, the disclosed rotary electric shaver includes an outer cutter set in which the outer cutter is assembled in an outer cutter holding unit and an inner cutter set in which the inner cutter is assembled in an inner cutter holding unit. The outer cutter set and the inner cutter set are respectively provided with a positioning convex portion on one side and a positioning concave portion on the other side. The positioning convex portion can fit in the positioning concave portion such that the outer cutter set can be assembled with the inner cutter set only in a case where the outer cutter set and the inner cutter set are in a predetermined assembly position.

Advantageous Effects

According to the disclosed rotary electric shaver, the outer cutter set and the inner cutter set can be free or prevented from being displaced from a predetermined assembly position when a user carries out maintenance such as cleaning. Therefore, it is possible to prevent sharpness in cutting at the time of shaving from being deteriorated and to maintain set sharpness in cutting for a long period.

DESCRIPTION OF THE EMBODIMENTS

Figure 1:
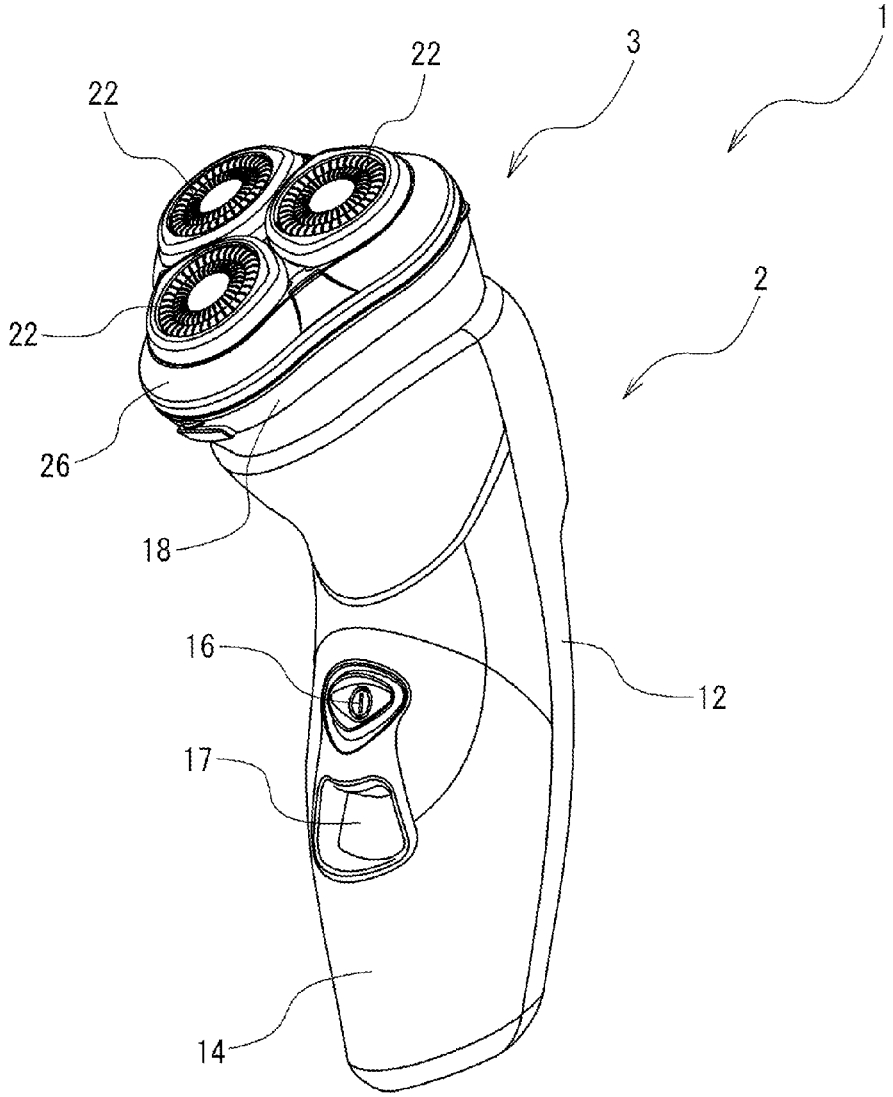
FIG. 1 is a schematic view (perspective view) illustrating an example of a rotary electric shaver according to an embodiment of the present invention.
Figure 2:
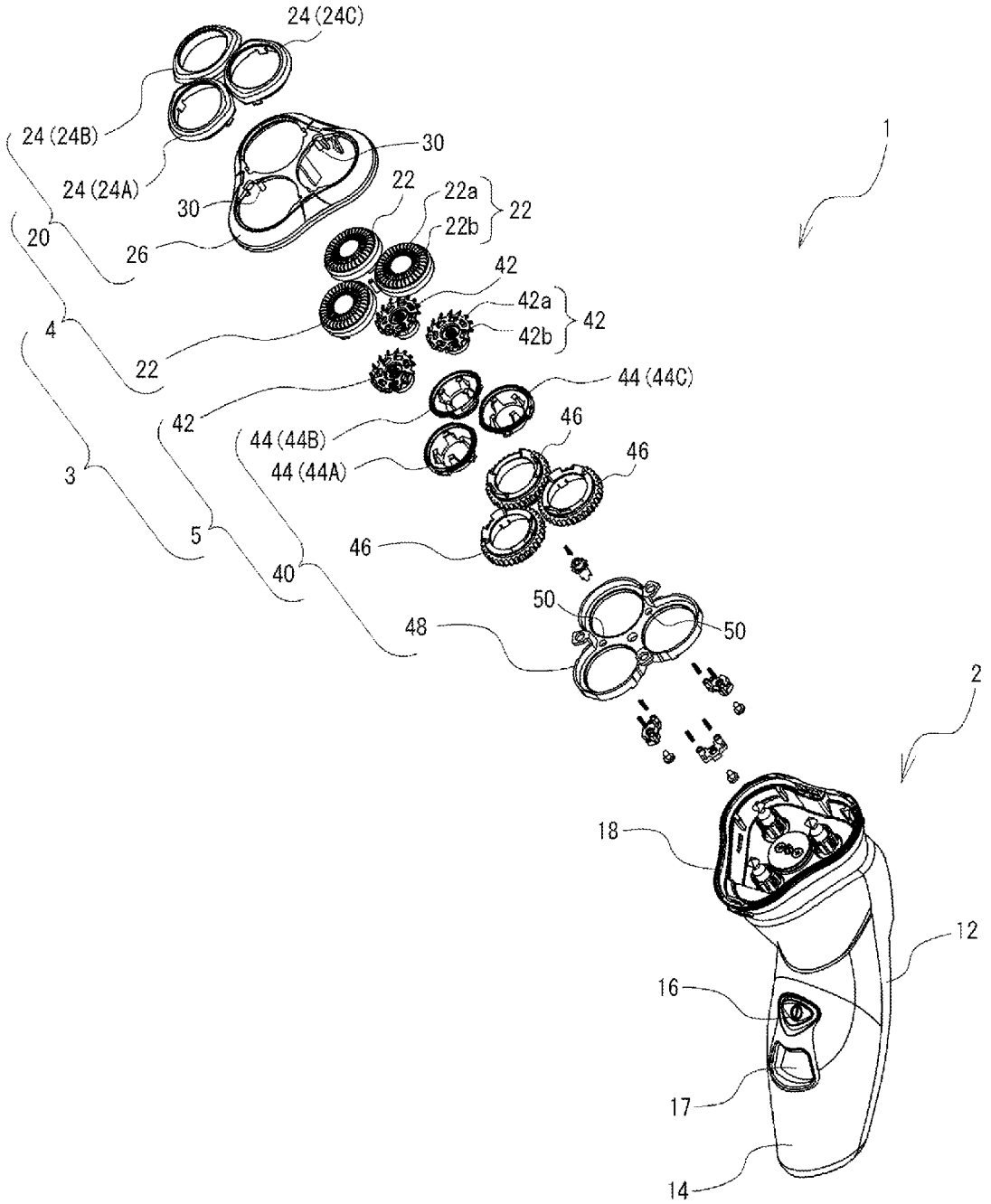
FIG. 2 is a schematic view (exploded perspective view) for describing a configuration of the rotary electric shaver illustrated in FIG. 1.

Hereinafter, referring to views, embodiments of the present invention will be described in detail. FIG. 1 is a perspective view (schematic view) illustrating an example of a rotary electric shaver 1 according to an embodiment of the invention. FIG. 2 is an exploded perspective view (schematic view) of a head portion of the rotary electric shaver 1. Throughout all the views for describing the embodiments, the same reference numerals are applied to members that have the same functions, and descriptions thereof may not be repeated.

According to an aspect of the invention, as illustrated in FIGS. 1 and 2, there is provided the rotary electric shaver 1 that includes an outer cutter 22 which has a shaving surface (below-described circular shaving surface) as a top surface where numerous hair introduction openings are formed and an inner cutter 42 which has a small cutter which rotates slidingly in contact with a bottom surface of the outer cutter 22 from below the shaving surface. The rotary electric shaver cuts hair entering the hair introduction openings with the outer cutter 22 and the inner cutter 42. The rotary electric shaver that has three sets of a combination of the outer cutter 22 and the inner cutter 42 will be exemplified for description without being limited thereto.

In FIG. 1, the reference numeral 2 is a main body portion that has a case 14 of which an upper portion of a substantially cylindrical-shaped grip portion 12 is bent in an obliquely front-upward direction. The case 14 is split into front and rear halves, and a rechargeable battery, an electric motor, a control circuit substrate (not illustrated), and the like are contained inside thereof. A power switch 16 is attached to a front surface of the case 14, and a display portion 17 that is configured to have an LED lamp indicating a remaining capacity of the battery, an operation state, and the like is provided below the switch 16.

A head portion 3 is openably and detachably attached to an upper portion of the case 14. The head portion 3 is tilted with respect to the grip portion 12 of the case 14 so as to direct the shaving surface (top surface of outer cutter 22) thereof in the obliquely front-upward direction. A rotation output shaft of the electric motor protrudes from the top surface of the case 14 toward an inside of the head portion 3 to rotationally drive the inner cutters 42 and elastically pushes the inner cutters 42 upward, thereby appropriately maintaining contact pressure with respect to a bottom surface of the outer cutters 22.

As illustrated in FIG. 2, the head portion 3 is configured by assembling an outer cutter set 4 and an inner cutter set 5, and detachably held with respect to a head holding mount 18 of the main body portion 2.

As illustrated in the same FIG. 2, the outer cutter set 4 according to the embodiment is configured to have the outer cutters 22 to be assembled in an outer cutter holding unit 20. Here, the outer cutter holding unit 20 is configured to include a cutter frame 26 and outer cutter rims 24 (24A, 24B and 24C). More specifically, the cutter frame 26 is substantially triangle-shaped in a front view and has a shape in which a peripheral edge is smoothly curved downward. Three circular mounting ports are formed in the cutter frame 26, and the outer cutter rims 24A, 24B and 24C are respectively held therein in a movable manner. Three outer cutters 22, 22 and 22 are configured to be respectively fit in the outer cutter rims 24A, 24B and 24C via stopper rings (not illustrated).

The outer cutter 22 is substantially disc-shaped in its entirety and has a shape in which a peripheral edge is bent downward such that various configurations can be employed. However, in the embodiment, two (dual) circular shaving surfaces 22*a* and 22*b* that are concentric with a center shaft, and a circular concave groove that is located therebetween are formed on the top surface of the outer cutter 22. However, the configuration is not limited thereto.

In addition, numerous hair introduction openings are formed in the circular shaving surfaces 22*a* and 22*b*, and the top surface thereof is configured to be in a more-protruded manner than the outer cutter rims 24. In the embodiment, slit-shaped hair introduction openings are included as the hair introduction opening. However, a shape of the hair introduction opening is not limited to the slit shape, and may be configured in a round-hole shape or the like.

Meanwhile, as illustrated in the same FIG. 2, the inner cutter set 5 according to the embodiment is configured to have the inner cutters 42 to be assembled in an inner cutter holding unit 40. Here, the inner cutter holding unit 40 is configured to include inner cutter holding members 44 (44A, 44B and 44C), cutter frame gears 46 and a cutter pressing plate 48. More specifically, three inner cutters 42, 42 and 42 are configured to be respectively fit in the inner cutter holding members 44A, 44B and 44C, thereby being assembled in three cutter frame gears 46, 46 and 46. The cutter pressing plate 48 holds the cutter frame gears 46, and elastically pushes up the outer cutter rims 24 when the outer cutter set 4 and the inner cutter set 5 are in an assembled state.

The inner cutter 42 is configured to include small cutters 42*a* and 42*b* that are slidingly in contact with the bottom surfaces (inner cutter sliding surface) of the shaving surfaces 22*a* and 22*b* of the outer cutter 22. The inner cutter 42 is connected to a drive shaft of the electric motor (not illustrated) via a joint (not illustrated) to be rotationally driven.

With the above-described configuration, the head portion 3 is detachable with respect to the head holding mount 18 of the main body portion 2. In addition, the head portion 3 has a configuration in which the outer cutter set 4 and the inner cutter set 5 can be freely assembled (connected) and disassembled (separated).

If the outer cutter set 4 and the inner cutter set 5 are assembled, each upper end edge of the small cutters 42*a* and 42*b* of the inner cutter 42 abuts on each bottom surface of the shaving surfaces 22*a* and 22*b* of the outer cutter 22. The inner cutter 42 is rotationally driven in the above-described state such that hair entering the hair introduction openings can be shaved.

Incidentally, as illustrated in FIGS. 1 and 2, in the rotary electric shaver 1, the outer cutter set 4 has a configuration in which three sets of outer cutters 22, 22 and 22 are disposed in a point symmetrical manner. In addition, the inner cutter set 5 has a configuration in which three sets of inner cutters 42, 42 and 42 are disposed in a point symmetrical manner. Accordingly, when assembling the outer cutter set and the inner cutter set, if each position is mutually displaced by 120°, three sets of assembly methods can be obtained.

Here, in the outer cutter set 4 and the inner cutter set 5, three sets of the outer cutters 22, 22, and 22 and three sets of the inner cutters 42, 42, and 42 that respectively correspond to each other are processed by the precision surface finishing in a predetermined assembly position. Accordingly, it is possible to perform set sharpness in cutting only in a case where the outer cutter set 4 and the inner cutter set 5 are in a predetermined assembly position.

However, for example, after a user (user of the rotary electric shaver) disassembles (separates) the outer cutter set 4 and the inner cutter set 5 for ordinary maintenance such as removing hair waste and washing, if the user assembles the outer cutter set 4 and the inner cutter set 5 out of a predetermined assembly position by mistake, it is not possible to perform the set sharpness in cutting, thereby causing a problem of deteriorated sharpness in cutting.

As a solution to the problem, the head portion 3 can have configurations according to embodiments described below.

(First Embodiment)

Figure 3:
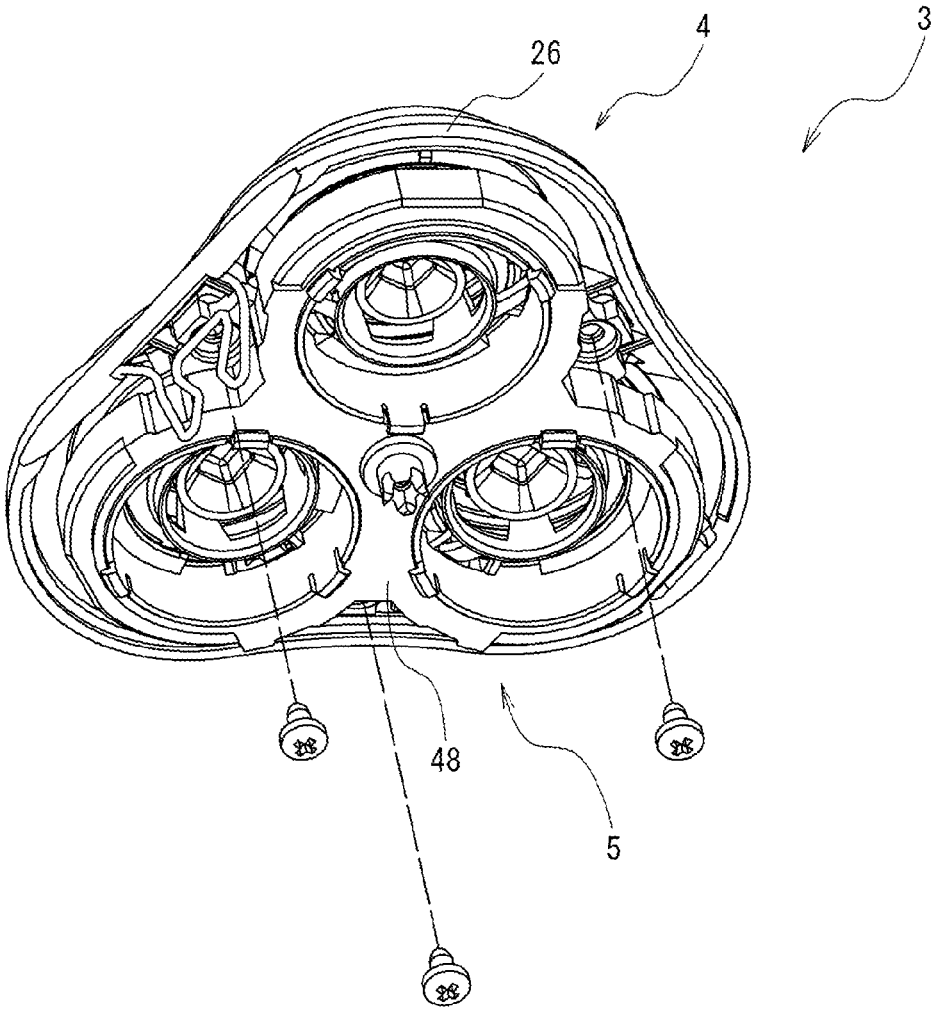
FIG. 3 is a schematic view (perspective view) illustrating a first embodiment of a head portion of the rotary electric shaver illustrated in FIG. 1.

The head portion 3 according to an embodiment has a configuration in which a user cannot separate the outer cutter set 4 and the inner cutter set 5 without using a tool. For example, as illustrated in FIG. 3, the outer cutter set 4 and the inner cutter set 5 are configured to be fixedly assembled by screw-fastening. In this way, the user cannot separate the outer cutter set 4 and the inner cutter set 5 without using a tool (screw driver). Accordingly, since the outer cutter set 4 and the inner cutter set 5 are not disassembled for ordinary maintenance such as cleaning by the user (or cannot be disassembled due to the hindrance), the problem that the user assembles the outer cutter set 4 and the inner cutter set 5 out of a predetermined assembly position by mistake after disassembling (separating) can be solved.

In addition, for another example, the outer cutter set 4 and the inner cutter set 5 may be configured to be fixedly assembled by bonding or welding (not illustrated). In this way, a configuration in which the outer cutter set 4 and the inner cutter set 5 cannot be separated by the user can be realized.

Furthermore, for still another example, the outer cutter set 4 and the inner cutter set 5 may be configured to be fixedly assembled by snap-fit-engaging (not illustrated). In this way, a configuration in which the outer cutter set 4 and the inner cutter set 5 cannot be separated, or are difficult to be separated by the user without using a tool (pliers or the like) can be realized.

(Second Embodiment)

Figure 4:
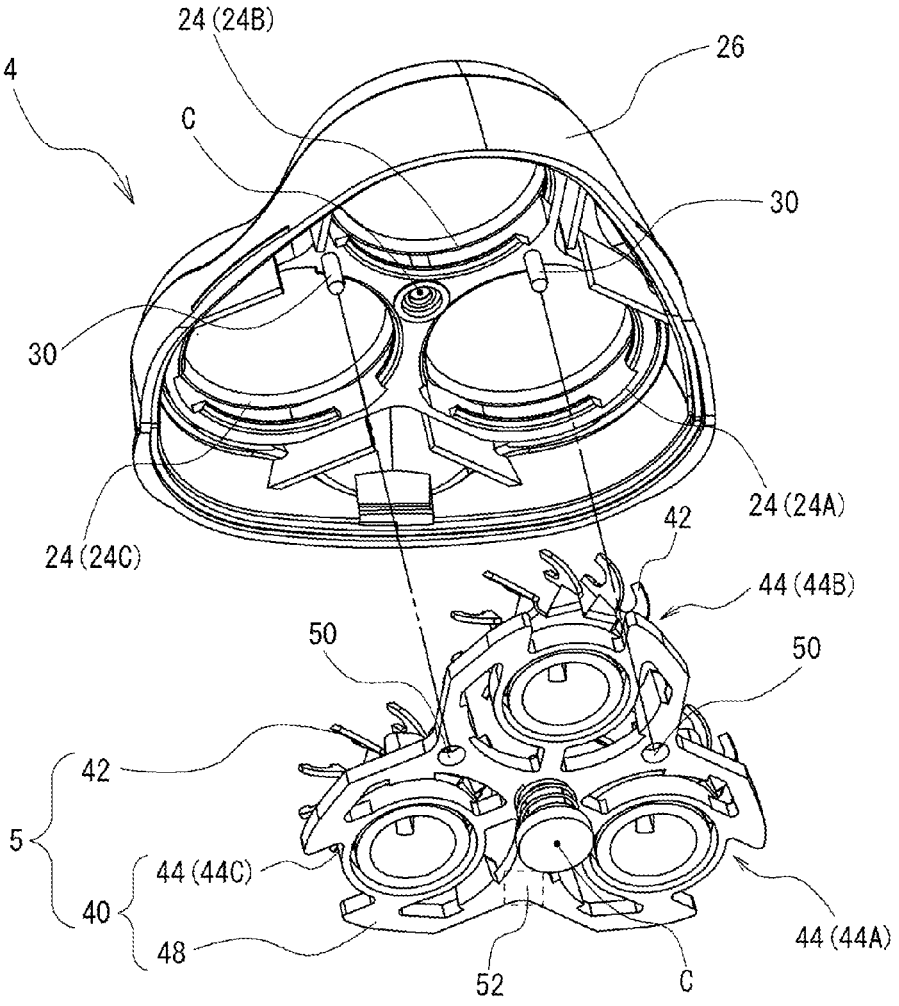
FIG. 4 is a schematic view (perspective view) illustrating a second embodiment of the head portion of the rotary electric shaver illustrated in FIG. 1.

The head portion 3 according to an embodiment has a configuration in which the outer cutter set 4 and the inner cutter set 5 can be mutually assembled only in a case where the outer cutter set 4 and the inner cutter set 5 are in a predetermined assembly position. For example, in a case of a rotary electric shaver including three sets of the outer cutters 22 and the inner cutters 42, as illustrated in FIG. 4, positioning convex portions 30 are provided on one of the outer cutter set 4 and the inner cutter set 5 (here, on the outer cutter set 4), and positioning concave portions 50 are provided on the other (here, on the inner cutter set 5). Furthermore, an interference portion 52 that hinders (prohibits) assembling of the outer cutter set 4 and the inner cutter set 5 by interfering with the positioning convex portion 30 on one (here, on the outer cutter set 4) when the outer cutter set 4 and the inner cutter set 5 are out of a predetermined assembly position is provided on the other (here, on the inner cutter set 5). The interference portion 52 according to the embodiment is formed at a point-symmetric (center C) position (refer to FIG. 4) in the inner cutter set 5 with respect to the positioning concave portions 50 as a flat plate portion that has no concave portion. According to the configuration, if each position of the outer cutter set 4 and the inner cutter set 5 is mutually displaced from a predetermined assembly position by 120°, one of the two positioning convex portions 30 can fit in the facing positioning concave portion 50. However, the other one cannot fit in the facing interference portion 52. Therefore, assembly of the outer cutter set 4 and the inner cutter set 5 can be hindered (prohibited).

As a modification example, a configuration in which the inner cutter set 5 includes the positioning convex portions 30 and the outer cutter set 4 includes the positioning concave portions 50 and the interference portion 52 may be employed (not illustrated).

Here, a "convex portion" of the positioning convex portion is defined as a term that includes all the protruding shapes such as a columnar shape, a conical or polygonal-cone shape and a plate shape. In addition, a "concave portion" of the positioning concave portion is defined as a term that includes all the fittable shapes with respect to the convex portion (protruding shape) such as a groove, a hole, a hollow, and a necessary space.

As in the above, the positioning convex portion 30 and the positioning concave portion 50 are configured to be fittable only in a case where the outer cutter set 4 and the inner cutter set 5 are in a predetermined assembly position (position illustrated in the same FIG. 4). Meanwhile, if the outer cutter set 4 and the inner cutter set 5 are out of a predetermined assembly position, the positioning convex portion 30 and the positioning concave portion 50 are configured to be non-fittable.

In this way, since the positioning convex portion 30 and the positioning concave portion 50 can fit each other only in a case where the outer cutter set 4 and the inner cutter set 5 are in a predetermined assembly position, it is possible to assemble the outer cutter set 4 and the inner cutter set 5. Accordingly, the problem that the user assembles the outer cutter set 4 and the inner cutter set 5 out of a predetermined assembly position by mistake after disassembling (separating) can be solved.

Figure 5:
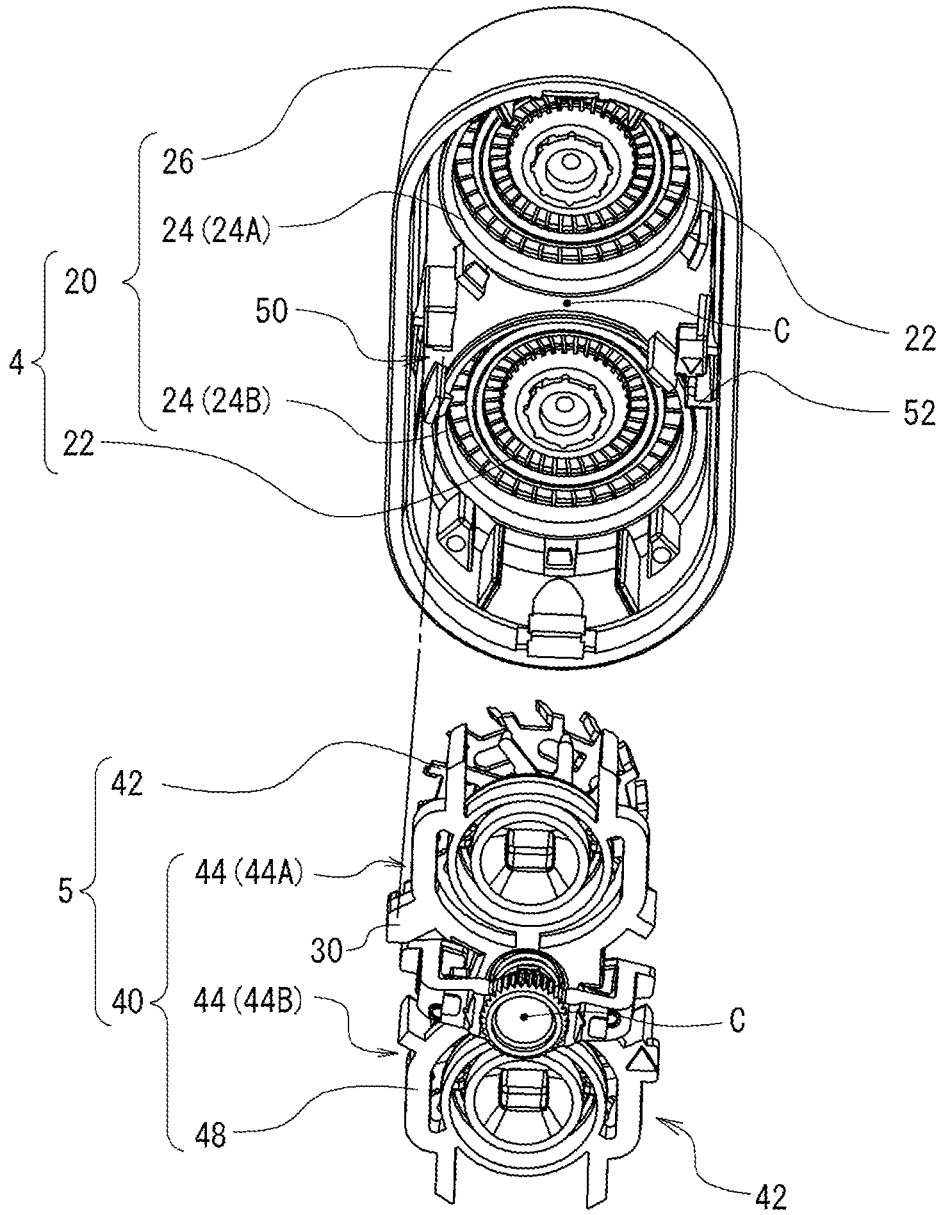
FIG. 5 is a schematic view (perspective view) illustrating the second embodiment (another example) of the head portion of the rotary electric shaver illustrated in FIG. 1.

In addition, for another example, FIG. 5 illustrates a case of a rotary electric shaver with two sets of the outer cutters 22 and the inner cutters 42.

As illustrated in the same FIG. 5, the positioning convex portion 30 is provided on one (here, on the inner cutter set 5) of the outer cutter set 4 and the inner cutter set 5, and the positioning concave portion 50 is provided on the other (here, on the outer cutter set 4). Furthermore, the interference portion 52 that hinders (prohibits) assembling of the outer cutter set 4 and the inner cutter set 5 by interfering with the positioning convex portion 30 on one (here, on the inner cutter set 5) when the outer cutter set 4 and the inner cutter set 5 are out of a predetermined assembly position is provided on the other (here, on the outer cutter set 4). The interference portion 52 according to the embodiment is formed at the point-symmetric (center C) position (refer to FIG. 5) with respect to the positioning concave portions 50 as a convex portion (protrusion portion) that abuts on the positioning convex portion 30 and hinders entering of the positioning convex portion 30 in the outer cutter set 4. According to the configuration, if each position of the outer cutter set 4 and the inner cutter set 5 is mutually displaced from a predetermined assembly position by 180°, the positioning convex portions 30 cannot fit in the facing interference portion 52. Therefore, assembly of the outer cutter set 4 and the inner cutter set 5 can be hindered (prohibited).

As a modification example, a configuration in which the outer cutter set 4 includes the positioning convex portions 30 and the inner cutter set 5 includes the positioning concave portions 50 and the interference portion 52 may be employed (not illustrated).

(Third Embodiment)

The head portion 3 according to an embodiment has a configuration in which the outer cutter set 4 and the inner cutter set 5 are guided to be assembled so as to be in a predetermined assembly position. More specifically, the outer cutter set 4 and the inner cutter set 5 are configured to be colored at members in surroundings of each outer cutter 22 in the outer cutter holding unit 20 and colored at members in surroundings of each inner cutter 42 in the inner cutter holding unit 40 so as to be in a matching color combination with each other only in a case where the outer cutter set 4 and the inner cutter set 5 are in a predetermined assembly position.

For example, a case of a rotary electric shaver including three sets of the outer cutters 22 and the inner cutters 42 will be described referring to FIG. 4 according to the second embodiment described above. The outer cutter rim 24A of the outer cutter holding unit 20 and the inner cutter holding member 44A of the inner cutter holding unit 40 are set in a matching color (for example, blue), the outer cutter rim 24B of the outer cutter holding unit 20 and the inner cutter holding member 44B of the inner cutter holding unit 40 are set in a matching color (for example, red), and the outer cutter rim 24C of the outer cutter holding unit 20 and the inner cutter holding member 44C of the inner cutter holding unit 40 are set in a matching color (for example, green) so as to be configured in a respectively colored manner. In this case, a coloring method is not particularly limited. A member may be formed after a raw material is colored, or a member may be colored using a coloring material after the member is formed. In addition, a method of attaching colored stickers to the members may be employed. The aforementioned examples of coloring are only exemplary examples without being limited to the colors thereof. In addition, in place of coloring, figures, marks and the like can be applied in a similar manner.

In this way, if the outer cutter set 4 and the inner cutter set 5 are in a predetermined assembly position, the outer cutter set 4 and the inner cutter set 5 are in combinations of the matching colors. That is, a color that is applied to a member (here, outer cutter rims 24) in the surroundings of each outer cutter 22 in the outer cutter holding unit 20 is the matching color with a color that is applied to a member (here, inner cutter holding members 44) in the surroundings of each inner cutter 42 in the inner cutter holding unit 40 to be in a combination. Therefore, since the user can easily recognize a predetermined assembly position for the outer cutter set 4 and the inner cutter set 5, the outer cutter set 4 and the inner cutter set 5 can be easily guided in the assembly position. Accordingly, the problem that the user assembles the outer cutter set 4 and the inner cutter set 5 out of a predetermined assembly position by mistake after disassembling (separating) can be solved.

In addition, for another example, a case of a rotary electric shaver including two sets of the outer cutters 22 and the inner cutters 42 will be described referring to FIG. 5 according to the second embodiment described above. The outer cutter rim 24A of the outer cutter holding unit 20 and the inner cutter holding member 44A of the inner cutter holding unit 40 are set in the matching color (for example, blue), and the outer cutter rim 24B of the outer cutter holding unit 20 and the inner cutter holding member 44B of the inner cutter holding unit 40 are set in the matching color (for example, red) so as to be configured in a respectively colored manner. Accordingly, similarly as in the above, the problem that the user assembles the outer cutter set 4 and the inner cutter set 5 out of a predetermined assembly position by mistake after disassembling (separating) can be solved.

As described hereinbefore, in the rotary electric shaver 1 according to the aspect of the invention, it is possible to prevent the outer cutter set 4 and the inner cutter set 5 from being assembled out of a predetermined assembly position when the user carries out ordinary maintenance such as cleaning. Therefore, it is possible to prevent sharpness in cutting at the time of shaving from being deteriorated, and maintain set sharpness in cutting for a long period.

The invention is not limited to the embodiments described above, and various modifications and changes can be made without departing from the scope of the invention. Particularly, although two sets and three sets of combination of the outer cutter and the inner cutter in the rotary electric shaver are exemplified for description, the invention is not limited thereto.

What is claimed is:

1. A rotary electric shaver that includes an outer cutter which has a circular shaving surface as a top surface where numerous hair introduction openings are formed and an inner cutter which has a small cutter which rotates slidingly in contact with a bottom surface of the outer cutter from below the shaving surface, the rotary electric shaver comprising:

an outer cutter set in which the outer cutter is assembled in an outer cutter holding unit; and an inner cutter set in which the inner cutter is assembled in an inner cutter holding unit, wherein the outer cutter set and the inner cutter set are respectively provided with a positioning convex portion on one of the outer cutter set and the inner cutter set and a positioning concave portion on one of the inner cutter set and the outer cutter set, and the positioning convex portion can fit in the positioning concave portion such that the outer cutter set can be assembled with the inner cutter set only when the outer cutter set and the inner cutter set are in one predetermined pattern assembly position, one of the outer cutter set and the inner cutter set is provided with an interference portion, and the positioning convex portion interferes with the interference portion such that the outer cutter set cannot be assembled with the inner cutter set when the outer cutter set and the inner cutter set are in other patterns of assembly positions except said one predetermined pattern of assembly position, and the interference portion is a flat plate portion into which the positioning convex portion cannot enter.

2. The rotary electric shaver according to claim 1, wherein the outer cutter set and the inner cutter set are colored in surroundings of each outer cutter in the outer cutter holding unit and colored in surroundings of each inner cutter in the inner cutter holding unit so as to be in a matching color combination with each other only when the outer cutter set and the inner cutter set are in a predetermined assembly position.

3. The rotary electric shaver according to claim 1, wherein the outer cutter set and the inner cutter set are fixed to each other by bonding, welding, screw-fastening, or snap-fit-engaging.

* * * * *